US008310332B2

(12) United States Patent
Yan et al.

(10) Patent No.: US 8,310,332 B2
(45) Date of Patent: Nov. 13, 2012

(54) HIGH CURRENT AMORPHOUS POWDER CORE INDUCTOR

(75) Inventors: Yipeng Yan, Shanghai (CN); Robert James Bogert, Lake Worth, FL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/247,821

(22) Filed: Oct. 8, 2008

(65) Prior Publication Data

US 2010/0085139 A1 Apr. 8, 2010

(51) Int. Cl.

| | |
|---|---|
| ***H01F 27/24*** | (2006.01) |
| ***H01F 27/02*** | (2006.01) |
| ***H01F 27/29*** | (2006.01) |
| ***H01F 17/04*** | (2006.01) |
| ***H01F 27/28*** | (2006.01) |

(52) U.S. Cl. ..... 336/221; 336/83; 336/192; 336/232; 336/233

(58) Field of Classification Search ..... 336/83, 336/192, 212, 220–223, 232–234; 29/606
See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |
| 4,072,780 | A | 2/1978 | Zillman |
| 4,313,152 | A | 1/1982 | Vranken |
| 4,543,553 | A | 9/1985 | Mandai et al. |
| 4,689,594 | A | 8/1987 | Kawabata et al. |
| 4,750,077 | A | 6/1988 | Amagasa |
| 4,758,808 | A | 7/1988 | Sasaki et al. |
| 4,803,425 | A | 2/1989 | Swanberg |
| 4,873,757 | A | 10/1989 | Williams |
| 5,032,815 | A | 7/1991 | Kobayashi et al. |
| 5,045,380 | A | 9/1991 | Kobayashi et al. |
| 5,250,923 | A | 10/1993 | Ushiro et al. |

(Continued)

FOREIGN PATENT DOCUMENTS

| | | | |
|---|---|---|---|
| EP | 0655754 | A1 | 5/1995 |

(Continued)

OTHER PUBLICATIONS

International Search Report and Written Opinion of PCT/US2009/057471; Dec .14, 2009; 14 pages.

(Continued)

*Primary Examiner* — Mohamad Musleh
*Assistant Examiner* — Mangtin Lian
(74) *Attorney, Agent, or Firm* — Armstrong Teasdale LLP

(57) ABSTRACT

A magnetic component and a method of manufacturing the same. The method comprises the steps of providing at least one shaped-core fabricated from an amorphous powder material, coupling at least a portion of at least one winding to the at least one shaped-core, and pressing the at least one shaped-core with at least a portion of the at least one winding. The magnetic component comprises at least one shaped-core fabricated from an amorphous powder material and at least a portion of at least one winding coupled to the at least one shaped-core, wherein the at least one shaped-core is pressed to at least a portion of the at least one winding. The winding may be preformed, semi-preformed, or non-preformed and may include, but is not limited to, a clip or a coil. The amorphous powder material may be an iron-based or cobalt-based amorphous powder material or a nanoamorphous powder material.

14 Claims, 4 Drawing Sheets

U.S. PATENT DOCUMENTS 5,257,000 A 10/1993 Billings et al.
5,300,911 A 4/1994 Walters
5,463,717 A 10/1995 Takatori et al.
5,500,629 A 3/1996 Meyer
5,515,022 A 5/1996 Tashiro et al.
5,532,667 A 7/1996 Haertling et al.
5,572,180 A 11/1996 Huang et al.
5,664,069 A 9/1997 Takatori et al.
5,761,791 A 6/1998 Bando
5,821,638 A 10/1998 Boys et al.
5,849,355 A 12/1998 McHenry
5,875,541 A 3/1999 Kumeji et al.
5,945,902 A 8/1999 Lipkes et al.
6,038,134 A 3/2000 Belter
6,054,914 A 4/2000 Abel et al.
6,114,939 A 9/2000 Wittenbreder
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 5/2002 Kato et al.
6,420,953 B1 7/2002 Dadafshar
6,449,829 B1 9/2002 Shafer
6,460,244 B1 10/2002 Shafer et al.
6,566,731 B2 5/2003 Ahn et al.
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,713,162 B2 3/2004 Takaya et al.
6,720,074 B2 4/2004 Zhang et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,864,201 B2 3/2005 Schultz et al.
6,879,238 B2 4/2005 Liu et al.
6,882,261 B2 4/2005 Moro et al.
6,885,276 B2 4/2005 Iha et al.
6,897,718 B2 5/2005 Yoshida et al.
6,908,960 B2 6/2005 Takaya et al.
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 * 3/2008 Liu et al. ..... 336/200
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,449,984 B2 * 11/2008 Kawarai ..... 336/83
7,481,989 B2 1/2009 Smalley et al.
7,485,366 B2 2/2009 Ma et al.
7,489,537 B2 2/2009 Tran
7,525,406 B1 * 4/2009 Cheng ..... 336/83
7,567,163 B2 7/2009 Dadafshar et al.
2001/0016977 A1 8/2001 Moro et al.
2001/0043135 A1 11/2001 Yamada et al.
2003/0029830 A1 2/2003 Takaya et al.
2003/0184423 A1 10/2003 Holdahl et al.
2004/0017276 A1 1/2004 Chen et al.
2004/0174239 A1 9/2004 Shibata et al.
2004/0210289 A1 10/2004 Wang et al.
2005/0151614 A1 7/2005 Dadafshar
2005/0174207 A1 8/2005 Young et al.
2006/0038651 A1 2/2006 Mizushima et al.
2006/0049906 A1 3/2006 Liu et al.
2006/0145800 A1 7/2006 Dadafshar et al.
2006/0158299 A1 * 7/2006 Sutardja ..... 336/174
2006/0186983 A1 * 8/2006 Ding et al. ..... 336/232
2006/0197644 A1 * 9/2006 Lin ..... 336/212
2006/0279395 A1 * 12/2006 Lee et al. ..... 336/221
2007/0132533 A1 * 6/2007 Shiu et al. ..... 336/83
2007/0175545 A1 * 8/2007 Urata et al. ..... 148/304
2007/0252669 A1 * 11/2007 Hansen et al. ..... 336/212
2008/0001702 A1 1/2008 Brunner
2008/0012674 A1 * 1/2008 Sano et al. ..... 336/83
2008/0061917 A1 3/2008 Manoukian et al.
2008/0110014 A1 5/2008 Shafer et al.
2008/0231401 A1 * 9/2008 Lee et al. ..... 336/83
2008/0310051 A1 12/2008 Yan et al.
2009/0058588 A1 3/2009 Suzuki et al.
2009/0066454 A1 * 3/2009 Hansen ..... 336/83
2009/0096565 A1 * 4/2009 Lanni ..... 336/178
2009/0179723 A1 7/2009 Ikriannikov et al.
2010/0007453 A1 1/2010 Yan et al.
2010/0026443 A1 2/2010 Yan et al.

FOREIGN PATENT DOCUMENTS

EP 1150312 A2 10/2001
EP 1486991 A1 12/2004
EP 1526556 A1 4/2005
EP 1564761 A1 8/2005
JP 6423121 2/1989
JP 07272932 10/1995
JP 2700713 1/1998
JP 10106839 4/1998
JP 3108931 11/2000
JP 3160685 4/2001
KR 20010014533 2/2001
KR 20020071285 9/2002
KR 20030081738 10/2003
WO 9205568 4/1992
WO 2005008692 A2 1/2005
WO 2006063081 A2 6/2006
WO 2008008538 A2 1/2008
WO 2009113775 A2 9/2009

OTHER PUBLICATIONS
International Search Report and Written Opinion of PCT/US2009/051005; Sep. 23, 2009; 15 pages.
International Search Report and Written Opinion of PCT/US2010/032992; Jul. 28, 2010; 15 pages.
International Search Report and Written Opinion of PCT/US2010/032803; Aug. 23, 2010; 16 pages.
International Search Report and Written Opinion of PCT/US20111024714; Apr. 21, 2011; 14 pages.
International Preliminary Report on Patentability and Written Opinion of PCT1US2009/057471; Apr. 21, 2011; 6 pages.

* cited by examiner

HIGH CURRENT AMORPHOUS POWDER CORE INDUCTOR

CROSS REFERENCE TO RELATED APPLICATIONS

The present application is related to the following patent applications, each of which is assigned to the assignee of the present patent application: (1) U.S. patent application Ser. No. 12/181,436, entitled "A Magnetic Electrical Device" and filed on Jul. 29, 2008 and (2) U.S. Provisional Patent Application Ser. No. 61/080,115, entitled "High Performance High Current Power Inductor" and filed on Jul. 11, 2008. Each of the above related applications are incorporated by reference herein.

TECHNICAL FIELD

The invention relates generally to electronic components and methods of manufacturing these components and, more particularly, to inductors, transformers, and the methods of manufacturing such items.

BACKGROUND

Typical inductors may include toroidal cores and shaped-cores, including a shield core and drum core, U core and I core, E core and I core, and other matching shapes. The typical core materials for these inductors are ferrite or normal powder core materials, which include iron (Fe), Sendust (Al—Si—Fe), MPP (Mo—Ni—Fe), and HighFlux (Ni—Fe). The inductors typically have a conductive winding wrapped around the core, which may include, but is not limited to a magnet wire coil that may be flat or rounded, a stamped copper foil, or a clip. The coil may be wound on the drum core or other bobbin core directly. Each end of the winding may be referred to as a lead and is used for coupling the inductor to an electrical circuit. The winding may be preformed, semi-preformed, or non-preformed depending upon the application requirements. Discrete cores may be bound together through an adhesive.

With the trend of power inductors going toward higher current, a need exists for providing inductors having more flexible form factors, more robust configurations, higher power and energy densities, higher efficiencies, and tighter inductance and Direct Current Resistance ("DCR") tolerance. DC to DC converters and Voltage Regulator Modules ("VRM") applications often require inductors having tighter DCR tolerances, which is currently difficult to provide due to the finished goods manufacturing process. Existing solutions for providing higher saturation current and tighter tolerance DCR in typical inductors have become very difficult and costly and do not provide the best performance from these typical inductors. Accordingly, the current inductors are in need for such improvements.

To improve certain inductor characteristics, toroidal cores have recently been manufactured using an amorphous powder material for the core material. Toroidal cores require a coil, or winding, to be wound onto the core directly. During this winding process, the cores may crack very easily, thereby causing the manufacturing process to be difficult and more costly for its use in surface-mount technology. Additionally, due to the uneven coil winding and coil tension variations in toroidal cores, the DCR is not very consistent, which is typically required in DC to DC converters and VRM. Due to the high pressures involved during the pressing process, it has not been possible to manufacture shaped-cores using amorphous powder materials.

Due to advancements in electronic packaging, the trend has been to manufacture power inductors having miniature structures. Thus, the core structure must have lower and lower profiles so that they may be accommodated by the modern electronic devices, some of which may be slim or have a very thin profile. Manufacturing inductors having a low profile has caused manufactures to encounter many difficulties, thereby making the manufacturing process expensive.

For example, as the components become smaller and smaller, difficulty has arisen due to the nature of the components being hand wound. These hand wound components provide for inconsistencies in the product themselves. Another encountered difficulty includes the shape-cores being very fragile and prone to core cracking throughout the manufacturing process. An additional difficulty is that the inductance is not consistent due to the gap deviation between the two discrete cores, including but not limited to drum cores and shielded cores, ER cores and I cores, and U cores and I cores, during assembly. A further difficulty is that the DCR is not consistent due to uneven winding and tension during the winding process. These difficulties represent examples of just a few of the many difficulties encountered while attempting to manufacture inductors having a miniature structure.

Manufacturing processes for inductors, like other components, have been scrutinized as a way to reduce costs in the highly competitive electronics manufacturing business. Reduction of manufacturing costs is particularly desirable when the components being manufactured are low cost, high volume components. In a high volume component, any reduction in manufacturing cost is, of course, significant. It may be possible that one material used in manufacturing may have a higher cost than another material. However, the overall manufacturing cost may be less by using the more costly material because the reliability and consistency of the product in the manufacturing process is greater than the reliability and consistency of the same product manufactured with the less costly material. Thus, a greater number of actual manufactured products may be sold, rather than being discarded. Additionally, it also is possible that one material used in manufacturing a component may have a higher cost than another material, but the labor savings more than compensates for the increase in material costs. These examples are just a few of the many ways for reducing manufacturing costs.

It has become desirable to provide a magnetic component having a core and winding configuration that can allow one or more of the following improvements, a more flexible form factor, a more robust configuration, a higher power and energy density, a higher efficiency, a wider operating frequency range, a wider operating temperature range, a higher saturation flux density, a higher effective permeability, and a tighter inductance and DCR tolerance, without substantially increasing the size of the components and occupying an undue amount of space, especially when used on circuit board applications. It also has become desirable to provide a magnetic component having a core and winding configuration that can allow low cost manufacturing and achieves more consistent electrical and mechanical properties. Furthermore, it is desirable to provide a magnetic component that tightly controls the DCR over large production lot sizes.

SUMMARY

A magnetic component and a method of manufacturing such a component is described. The magnetic component may include, but is not limited to, an inductor or a transformer. The method comprises the steps of providing at least one shaped-core fabricated from an amorphous powder material, coupling at least a portion of at least one winding to the at least one shaped-core, and pressing the at least one shaped-core with at least a portion of the at least one winding. The magnetic component comprises at least one shaped-core fabricated from an amorphous powder material and at least a portion of at least one winding coupled to the at least one shaped-core, wherein the at least one shaped-core is pressed to at least a portion of the at least one winding. The winding may be preformed, semi-preformed, or non-preformed and may include, but is not limited to, a clip or a coil. The amorphous powder material may be an iron-based amorphous powder material or a nanoamorphous powder material.

According to some aspects, two shaped-cores are coupled together with a winding positioned therebetween. In these aspects, one of the shaped-cores is pressed, and the winding is coupled to the pressed shaped-core. The other shaped-core is coupled to the winding and the pressed shaped-core and pressed again to form the magnetic component. The shaped-core may be fabricated from an amorphous powder material or a nanoamorphous powder material.

According to other exemplary aspects, the amorphous powder material is coupled around at least one winding. In these aspects, the amorphous powder material and the at least one winding are pressed together to form the magnetic component, wherein the magnetic component has a shaped-core. According to these aspects, the magnetic component may have a single shaped-core and a single winding, or it may comprise a plurality of shaped-cores within a single structure, wherein each of the shaped-cores has a corresponding winding. Alternatively, the shaped-core may be fabricated from a nanoamorphous powder material.

These and other aspects, objects, features, and advantages of the invention will become apparent to a person having ordinary skill in the art upon consideration of the following detailed description of illustrated exemplary embodiments, which include the best mode of carrying out the invention as presently perceived.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF EXEMPLARY EMBODIMENTS

Referring to FIGS. 1-5, several views of various illustrative, exemplary embodiments of a magnetic component or device are shown. In an exemplary embodiment the device is an inductor, although it is appreciated that the benefits of the invention described below may accrue to other types of devices. While the materials and techniques described below are believed to be particularly advantageous for the manufacture of low profile inductors, it is recognized that the inductor is but one type of electrical component in which the benefits of the invention may be appreciated. Thus, the description set forth is for illustrative purposes only, and it is contemplated that benefits of the invention accrue to other sizes and types of inductors, as well as other electronic components, including but not limited to transformers. Therefore, practice of the inventive concepts herein is not limited solely to the exemplary embodiments described herein and illustrated in the figures. Additionally, it is understood that the figures are not to scale, and that the thickness and other sizes of the various components have been exaggerated for the purpose of clarity.

Figure 1:
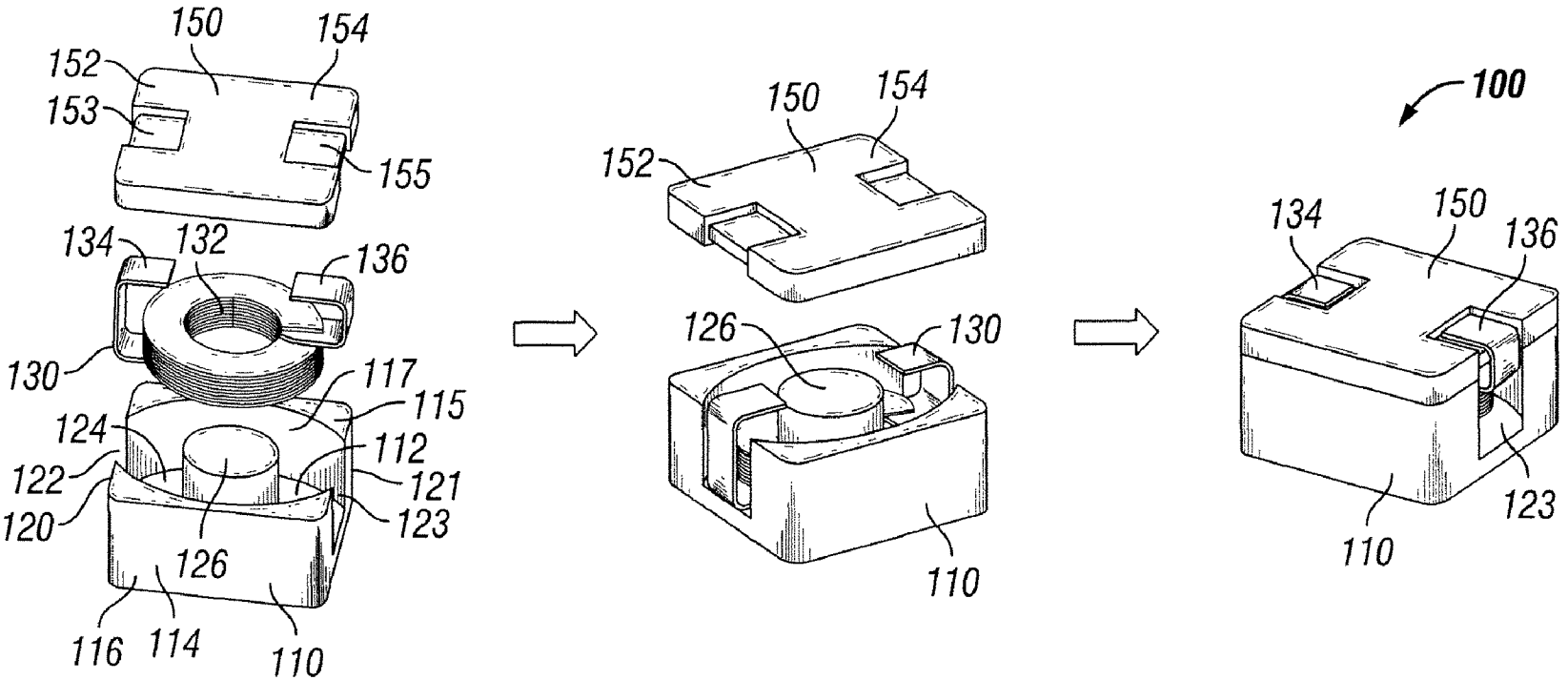
FIG. 1 illustrates a perspective view of a power inductor having an ER-I shaped-core during multiple stages in the manufacturing process, in accordance with an exemplary embodiment.

FIG. 1 illustrates a perspective view of a power inductor having an ER-I shaped-core during multiple stages in the manufacturing process, in accordance with an exemplary embodiment. In this embodiment, the power inductor 100 comprises an ER core 110, a preformed coil 130, and an I core 150.

The ER core 110 is generally square or rectangular in shape and has a base 112, two side walls 114, 115, two end walls 120, 121, a receptacle 124, and a centering projection or post 126. The two side walls 114, 115 extend the entire longitudinal length of the base 112 and have an exterior surface 116 and an interior surface 117, wherein the interior surface 117 is proximate to the centering projection 126. The exterior surface 116 of the two side walls 114, 115 are substantially planar, while the interior surface 117 of the two side walls are concave. The two end walls 120, 121 extend a portion of the width of the base 112 from the ends of each side wall 114, 115 of the base 112, such that a gap 122, 123 is formed in each of the two end walls 120, 121, respectively. This gap 122, 123 may be formed substantially in the center of each of the two end walls 120, 121 such that the two side walls 114, 115 are mirror images of one another. The receptacle 124 is defined by the two side walls 114, 115 and the two end walls 120, 121. The centering projection 126 may be centrally located in the receptacle 124 of the ER core 110 and may extend upwardly from the base 112 of the ER core 110. The centering projection 126 may extend to a height that is substantially the same as the height of the two side walls 114, 115 and the two end walls 120, 121, or the height may extend less than the height of the two side walls 114, 115 and the two end walls 120, 121. As such, the centering projection 126 extends into an inner periphery 132 of the preformed coil 130 to maintain the preformed coil 130 in a fixed, predetermined, and centered position with respect to the ER core 110. Although the ER core is described as having a symmetrical core structure in this embodiment, the ER core may have an asymmetrical core structure without departing from the scope and spirit of the exemplary embodiment.

The preformed coil 130 has a coil having one or more turns, and two terminals 134, 136, or leads, that extend from the preformed coil 130 at 180° from one another. The two terminals 134, 136 extend in an outwardly direction from the preformed coil 130, then in an upward direction, and then back in an inward direction towards the preformed coil 130; thereby each forming a U-shaped configuration. The preformed coil 130 defines the inner periphery 132 of the preformed coil 130. The configuration of the preformed coil 130 is designed to couple the preformed coil 130 to the ER core 110 via the centering projection 126, such that the centering projection 126 extends into the inner periphery 132 of the preformed coil 130. The preformed coil 130 is fabricated from copper and is plated with nickel and tin. Although the preformed coil 130 is made from copper and has nickel and tin plating, other suitable conductive materials, including but not limited to gold plating and soldering, may be utilized in fabricating the preformed coil 130 and/or the two terminals 134, 136 without departing from the scope and spirit of the invention. Additionally, although a preformed coil 130 has been depicted as one type of winding that may be used within this embodiment, other types of windings may be utilized without departing from the scope and spirit of the invention. Additionally, although this embodiment utilizes a preformed coil 130, semi-preformed windings, and non-preformed windings may also be used without departing from the scope and spirit of the invention. Further, although the terminals 134, 136 have been described in a particular configuration, alternative configurations may be used for the terminals without departing from the scope and spirit of the invention. Moreover, the geometry of the preformed coil 130 may be circular, square, rectangular, or any other geometric shape without departing from the scope and spirit of the invention. The interior surface of the two side walls 114, 115 and the two end walls 120, 121 may be reconfigured accordingly to correspond to the geometry of the preformed coil 130, or winding. In the event the coil 130 has multiple turns, insulation between the turns may be required. The insulation may be a coating or other type of insulator that may be placed between the turns.

The I core 150 is generally square or rectangular in shape and substantially corresponds to the footprint of the ER core 110. The I core 150 has two opposing ends 152, 154, wherein each end 152, 154 has a recessed portion 153, 155, respectively, to accommodate an end portion of the terminals 134, 136. The recessed portions 153, 155 are substantially the same width, or slightly larger in width, when compared to the width of the end portion of the terminals 134, 136.

In an exemplary embodiment, the ER core 110 and the I core 150 are both fabricated from an amorphous powder core material. According to some embodiments, the amorphous powder core material can be an iron-based amorphous powder core material. One example of the iron-based amorphous powder core material comprises approximately 80% iron and 20% other elements. According to alternative embodiments, the amorphous powder core material can be a cobalt-based amorphous powder core material. One example of the cobalt-based amorphous powder core material comprises approximately 75% cobalt and 25% other elements. Still, according to some other alternative embodiments, the amorphous powder core material can be a nanoamorphous powder core material.

This material provides for a distributed gap structure, wherein the binder material behaves as gaps within the fabricated iron-based amorphous powder material. An exemplary material is manufactured by Amosense in Seoul, Korea and sold under product number APHxx (Advanced Powder Core), where xx represents the effective permeability of the material. For example, if the effective permeability for the material is 60, the part number is APH60. This material is capable of being used for high current power inductor applications. Additionally, this material may be used with higher operating frequencies, typically in the range of about 1 MHz to about 2 MHz, without producing abnormal heating of the inductor 100. Although the material may be used in the higher frequency range, the material may be used in lower and higher frequency ranges without departing from the scope and spirit of the invention. The amorphous powder core material can provide a higher saturation flux density, a lower hysteresis core loss, a wider operating frequency range, a wider operating temperature range, better heat dissipation and a higher effective permeability. Additionally, this material can provide for a lower loss distributed gap material, which thereby can maximize the power and energy density. Typically, the effective permeability of shaped-cores is not very high due to pressing density concerns. However, use of this material for the shaped-cores can allow a much higher effective permeability than previously available. Alternatively, the nanoamorphous powder material can allow up to three times higher permeability when compared to the permeability of an iron-based amorphous powder material.

As illustrated in FIG. 1, the ER core 110 and the I core 150 are pressed molded from amorphous powder material to form the solid shaped-cores. Upon pressing the ER core 110, the preformed coil 130 is coupled to the ER core 110 in the manner previously described. The terminals 134, 136 of the preformed coil 130 extend through the gaps 122, 123 in the two end walls 120, 121. The I core 150 is then coupled to the ER core 110 and the preformed coil 130 such that the ends of the terminals 134, 136 are coupled within the recessed portions 153, 155, respectively, of the I core 150. The ER core 110, the preformed coil 130, and the I core 150 are then pressed molded together to form the ER-I inductor 100. Although the I core 150 has been illustrated as having recessed portions 153, 155 formed in the two opposing ends 152, 154, the I core 150 may have the recessed portions omitted without departing from the scope and spirit of the invention. Also, although the I core 150 has been illustrated to be symmetrical, asymmetrical I cores may be used, including I cores having mistake proofing, as described below, without departing from the scope and spirit of the invention.

Figure 2:
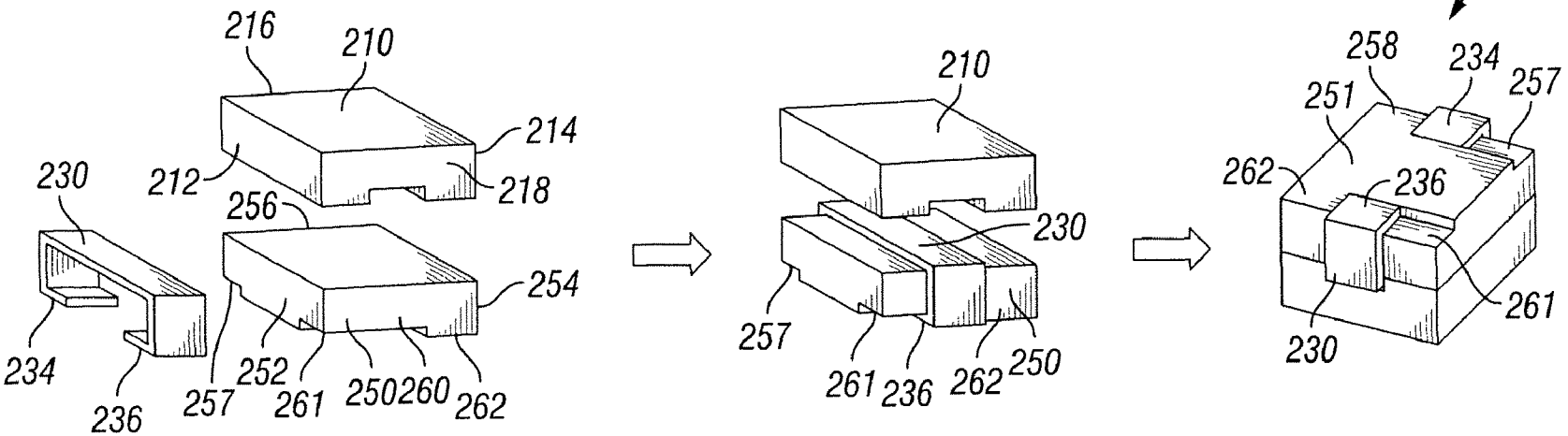
FIG. 2 illustrates a perspective view of a power inductor having a U-I shaped-core during multiple stages in the manufacturing process, in accordance with an exemplary embodiment.

FIG. 2 illustrates a perspective view of a power inductor having a U-I shaped-core, during multiple stages in the manufacturing process, in accordance with an exemplary embodiment. In this embodiment, the power inductor 200 comprises a U core 210, a preformed clip 230, and an I core 250. As used herein and throughout the specification, the U core 210 has two sides 212, 214 and two ends 216, 218, wherein the two sides 212, 214 are parallel with respect to the orientation of the winding, or clip, 230 and the two ends 216, 218 are perpendicular with respect to the orientation of the winding, or clip 230. Additionally, the I core 250 has two sides 252, 254 and two ends 256, 260, wherein the two sides 252, 254 are parallel with respect to the orientation of the winding, or clip, 230 and the two ends 256, 260 are perpendicular with respect to the orientation of the winding, or clip 230. According to this embodiment, the I core 250 has been modified to provide for a mistake proof I core 250. The mistake proof I core 250 has removed portions 257, 261 from two parallel ends 256, 260, respectively at one side 252 of the bottom 251 of the mistake proof I core 250 and non-removed portions 258, 262 from the same two parallel ends 256, 260, respectively, at the opposing side 254 of the mistake proof I core 250.

The preformed clip 230 has two terminals 234, 236, or leads, that may be coupled around the mistake proof I core 250 by positioning the preformed clip 230 at the removed portions 257, 261 and sliding the preformed clip 230 towards the non-removed portions 258, 262 until the preformed clip 230 may not be moved further. The preformed clip 230 can allow better DCR control, when compared to a non-preformed clip, because bending and cracking of platings is greatly reduced in the manufacturing process. The mistake proof I core 250 enables the preformed clip 230 to be properly positioned so that the U core 210 may be quickly, easily, and correctly coupled to the mistake proof I core 250. As shown in FIG. 2, only the bottom 251 of the mistake proof I core 250 provides the mistake proofing. Although only the bottom 251 of the mistake proof I core 250 provides the mistake proofing in this embodiment, alternative sides, either alone or in combination with another side, may provide the mistake proofing without departing from the scope and spirit of the exemplary embodiment. For example, the mistake proofing may be located only at the opposing ends 256, 260 or at the opposing ends 256, 260 and the bottom 251 of the I core, instead of only at the bottom 251 of the I core 250 as depicted in FIG. 2. Additionally, the I core 250 may be formed without any mistake proofing according some alternative embodiments.

The preformed clip 230 is fabricated from copper and is plated with nickel and tin. Although the preformed clip 230 is made from copper and has nickel and tin plating, other suitable conductive materials, including but not limited to gold plating and soldering, may be utilized in fabricating the preformed clip 230 and/or the two terminals 234, 236 without departing from the scope and spirit of the invention. Additionally, although a preformed clip 230 is used in this embodiment, the clip 230 may be partially preformed or not preformed without departing from the scope and spirit of the invention. Furthermore, although a preformed clip 230 is depicted in this embodiment, any form of winding may be used without departing from the scope and spirit of the invention.

Figure 3B:
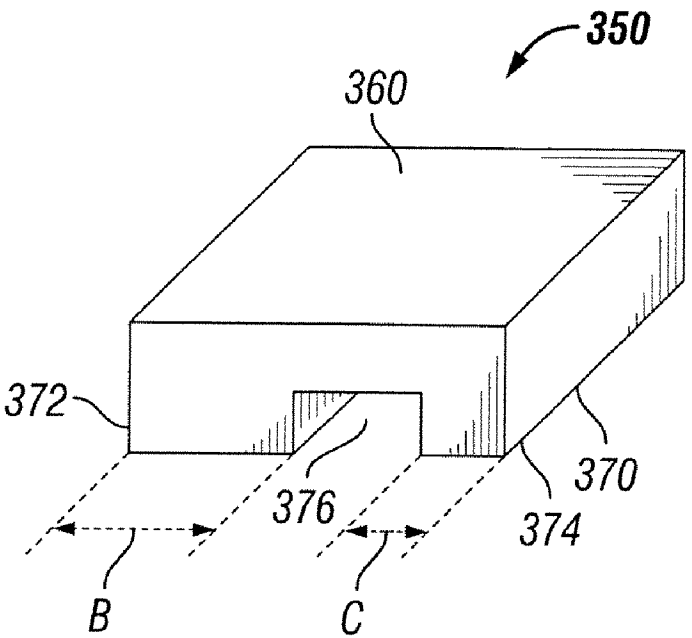
FIG. 3B illustrates a perspective view of an asymmetrical U core in accordance with an exemplary embodiment.
Figure 3A:
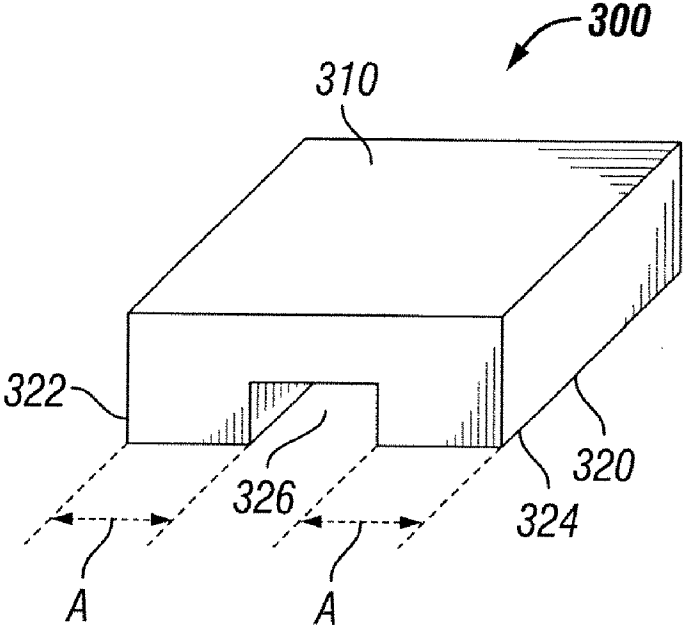
FIG. 3A illustrates a perspective view of a symmetrical U core in accordance with an exemplary embodiment.

The removed portions 257, 261 from the mistake proof I core 250 may be dimensioned such that a symmetrical U core or an asymmetrical U core, which are described with respect to FIG. 3A and FIG. 3B respectively, may be utilized without departing from the scope and spirit of the invention. The U core 210 is dimensioned to have a width substantially the same as the width of the mistake proof I core 250 and a length substantially the same as the length of the mistake proof I core 250. Although the dimensions of the U core 210 have been illustrated above, the dimensions may be altered without departing from the scope and spirit of the invention.

FIG. 3A illustrates a perspective view of a symmetrical U core in accordance with an exemplary embodiment. The symmetrical U core 300 has one surface 310 and an opposing surface 320, wherein the one surface 310 is substantially planar, and the opposing surface 320 has a first leg 322, a second leg 324, and a clip channel 326 defined between the first leg 322 and the second leg 324. In the symmetrical U core 300, the width of the first leg 322 is substantially equal to the width of the second leg 324. This symmetrical U core 300 is coupled to the I core 250, and a portion of the preformed clip 230 is positioned within the clip channel 326. According to certain exemplary embodiments, the terminals 234, 236 of the preformed clip 230 are coupled to the bottom surface 251 of the I core 250. However, in alternative exemplary embodiments, the terminals 234, 236 of the preformed clip 230 may be coupled to the one surface 310 of the U core 300.

FIG. 3B illustrates a perspective view of an asymmetrical U core in accordance with an exemplary embodiment. The asymmetrical U core 350 has one surface 360 and an opposing surface 370, wherein the one surface 360 is substantially planar, and the opposing surface 370 has a first leg 372, a second leg 374, and a clip channel 376 defined between the first leg 372 and the second leg 374. In the asymmetrical U core 350, the width of the first leg 372 is not substantially equal to the width of the second leg 374. This asymmetrical U core 350 is coupled to the I core 250, and a portion of the preformed clip 230 is positioned within the clip channel 376. According to certain exemplary embodiments, the terminals 234, 236 of the preformed clip 230 are coupled to the bottom surface 251 of the I core 250. However, in alternative exemplary embodiments, the terminals 234, 236 of the preformed clip 230 may be coupled to the one surface 360 of the U core 350. One reason for using an asymmetrical U core 350 is to provide a more even flux density distribution throughout the entire magnetic path.

In an exemplary embodiment, the U core 210 and the I core 250 are both fabricated from an amorphous powder core material, which is the same material as described above in reference to the ER core 110 and the I core 150. According to some embodiments, the amorphous powder core material can be an iron-based amorphous powder core material. Additionally, a nanoamorphous powder material may also be used for these core materials. As illustrated in FIG. 2, the preformed clip 230 is coupled to the I core 250, and the U core 210 is coupled to the I core 250 and the preformed clip 230 such that the preformed clip 230 is positioned within the clip channel of the U core 210. The U core 210 can be symmetrical as shown with U core 310 or asymmetrical as shown with U core 350. The U core 210, the preformed clip 230, and the I core 250 are then pressed molded together to form the UI inductor 200. The press molding removes the physical gap that is generally located between the preformed clip 230 and the core 210, 250 by having the cores 210, 250 form molded around the preformed clip 230.

Figure 4:
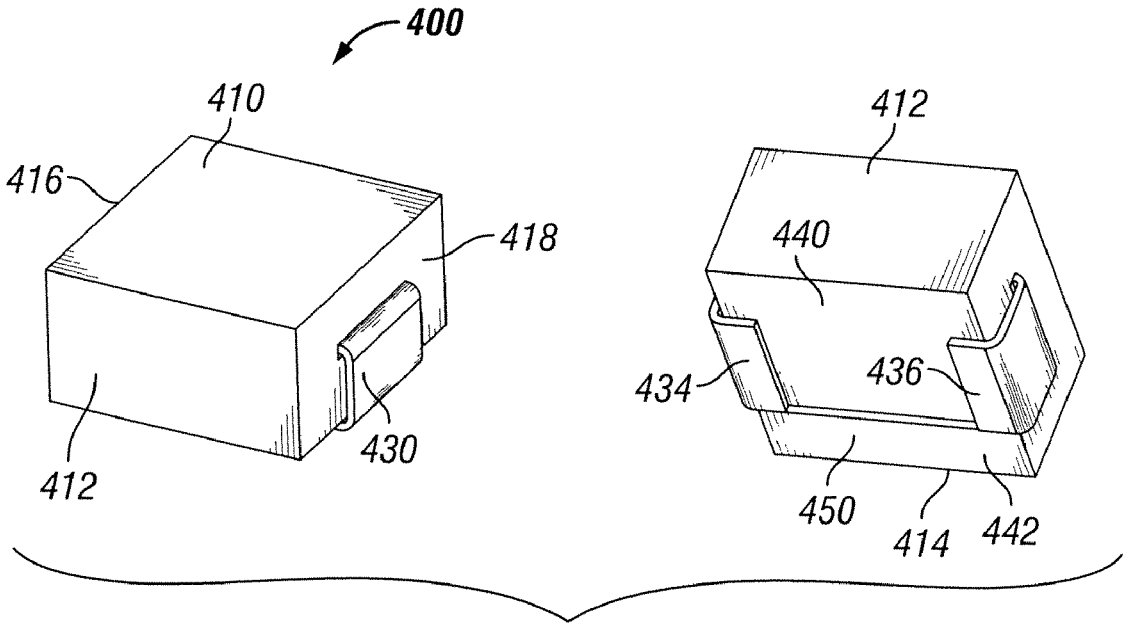
FIG. 4 illustrates a perspective view of a power inductor having a bead core in accordance with an exemplary embodiment.

FIG. 4 illustrates a perspective view of a power inductor having a bead core in accordance with an exemplary embodiment. In this embodiment, the power inductor 400 comprises a bead core 410 and a semi-preformed clip 430. As used herein and throughout the specification, the bead core 410 has two sides 412, 414 and two ends 416, 418, wherein the two sides 412, 414 are parallel with respect to the winding, or clip, 430 and the two ends 416, 418 are perpendicular with respect to the winding, or clip 430.

In an exemplary embodiment, the bead core 410 is fabricated from an amorphous powder core material, which is the same material as described above in reference to the ER core 110 and the I core 150. According to some embodiments, the amorphous powder core material can be an iron-based amorphous powder core material. Additionally, a nanoamorphous powder material may also be used for these core materials.

The semi-preformed clip 430 comprises two terminals, or leads, 434, 436 at opposing two ends 416, 418 and may be coupled to the bead core 410 by having a portion of the semi-preformed clip 430 pass centrally within the bead core 410 and having the two terminals 434, 436 wrap around the two ends 416, 418 of the bead core 410. The semi-preformed clip 430 can allow better DCR control, when compared to a non-preformed clip, because bending and cracking of platings is greatly reduced in the manufacturing process.

The semi-preformed clip 430 is fabricated from copper and is plated with nickel and tin. Although the semi-preformed clip 430 is made from copper and has nickel and tin plating, other suitable conductive materials, including but not limited to gold plating and soldering, may be utilized in fabricating the semi-preformed clip 430 without departing from the scope and spirit of the invention. Additionally, although a semi-preformed clip 430 is used in this embodiment, the clip 430 may be not preformed without departing from the scope and spirit of the invention. Furthermore, although a semi-preformed clip 430 is depicted in this embodiment, any form of winding may be used without departing from the scope and spirit of the invention.

As illustrated in FIG. 4, the semi-preformed clip 430 is coupled to the bead core 410 by having a portion of the semi-preformed clip 430 pass within the bead core 410 and having the two terminals 434, 436 wrap around the two ends 416, 418 of the bead core 410. In some embodiments, the bead core 410 can be modified to have a removed portion 440 from one side 412 of the bottom 450 of the bead core 410 and a non-removed portion 442 from the opposing side 414 of the bead core 410. The two terminals 434, 436 of the semi-preformed clip 430 can be positioned at the bottom 450 of the bead core 410 such that the terminals 434, 436 are located within the removed portion 442. Although the bead core has been illustrated having a removed portion and a non-removed portion, the bead core may be formed to omit the removed portion without departing from the scope and spirit of the invention.

According to an exemplary embodiment, the amorphous powder core material may be initially formed into a sheet and then wrapped or rolled around the semi-preformed clip 430. Upon rolling the amorphous powder core material around the semi-preformed clip 430, the amorphous powder core material and the semi-preformed clip 430 can then be pressed at high pressures, thereby forming the power inductor 400. The press molding removes the physical gap that is generally located between the semi-preformed clip 430 and the bead core 410 by having the bead core 410 form molded around the semi-preformed clip 430.

According to another exemplary embodiment, the amorphous powder core material and the semi-preformed clip 430 may be positioned within a mold (not shown), such that the amorphous powder core material surrounds at least a portion of the semi-preformed clip 430. The amorphous powder core material and the semi-preformed clip 430 can then be pressed at high pressures, thereby forming the power inductor 400. The press molding removes the physical gap that is generally located between the semi-preformed clip 430 and the bead core 410 by having the bead core 410 form molded around the semi-preformed clip 430.

Additionally, other methods may be used to form the inductor described above. In a first alternative method, a bead core may be formed by pressing the amorphous powder core material at high pressures, followed by coupling the winding to the bead core, and then followed by adding additional amorphous powder core material to the bead core so that the winding is disposed between the bead core and at least a portion of the additional amorphous powder core material. The bead core, the winding and the additional amorphous powder core material are then pressed together at high pressures to form the power inductor described in this embodiment. In a second alternative method, two discrete shaped cores may be formed by pressing the amorphous powder core material at high pressures, followed by positioning the winding between the two discrete shaped cores, and then followed by adding additional amorphous powder core material. The two discrete shaped cores, the winding, and the additional amorphous powder core material are then pressed together at high pressures to form the power inductor described in this embodiment. In a third alternative method, injection molding can be used to mold the amorphous powder core material and the winding together. Although a bead core is described in this embodiment, other shaped cores may be utilized without departing from the scope and spirit of the exemplary embodiment.

Figure 5:
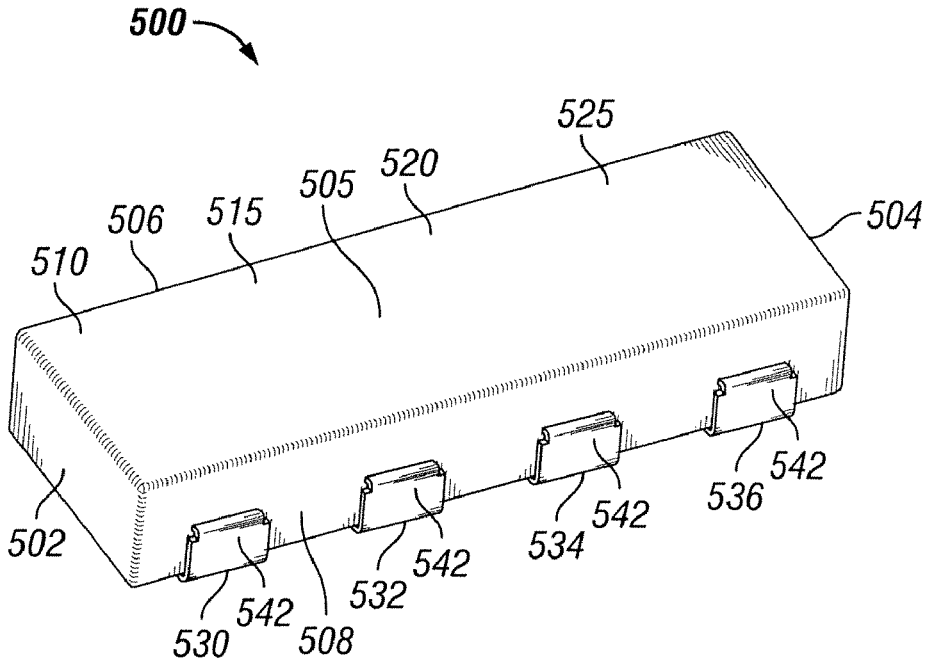
FIG. 5 illustrates a perspective view of a power inductor having a plurality of U shaped-cores formed as a single structure in accordance with an exemplary embodiment.

FIG. 5 illustrates a perspective view of a power inductor having a plurality of U shaped-cores formed as a single structure in accordance with an exemplary embodiment. In this embodiment, the power inductor 500 comprises four U shaped-cores 510, 515, 520, 525 formed as a single structure 505 and four clips 530, 532, 534, 536, wherein each clip 530, 532, 534, 536 is coupled to a respective one of the U shaped-core 510, 515, 520, 525 and wherein each clip 530, 532, 534, 536 is not preformed. As used herein and throughout the specification, the inductor 500 has two sides 502, 504 and two ends 506, 508, wherein the two sides 502, 504 are parallel with respect to the windings, or clips, 530, 532, 534, 536, and the two ends 506, 508 are perpendicular with respect to the windings, or clips, 530, 532, 534, 536. Although four U cores 510, 515, 520, 525 and four clips 530, 532, 534, 536 are shown to form a single structure 505, greater or fewer U cores, with a corresponding number of clips, may be used to form the single structure without departing from the scope and spirit of the invention.

In an exemplary embodiment, the core material is fabricated from an iron-based amorphous powder core material, which is the same material as described above in reference to the ER core 110 and the I core 150. Additionally, a nanoamorphous powder material may also be used for these core materials.

Each clip 530, 532, 534, 536 has two terminals, or leads, 540 (not shown), 542 at opposing ends and may be coupled to each of the U shaped-cores 510, 515, 520, 525 by having a portion of the clip 530, 532, 534, 536 pass centrally within each of the U shaped-cores 510, 515, 520, 525 and having the two terminals 540 (not shown), 542 of each clip 530, 532, 534, 536 wrap around the two ends 506, 508 of the inductor 500.

The clips 530, 532, 534, 536 are fabricated from copper and are plated with nickel and tin. Although the clips 530, 532, 534, 536 are made from copper and has nickel and tin plating, other suitable conductive materials, including but not limited to gold plating and soldering, may be utilized in fabricating the clips without departing from the scope and spirit of the invention. Additionally, although the clips 530, 532, 534, 536 are depicted in this embodiment, any form of windings may be used without departing from the scope and spirit of the invention.

As illustrated in FIG. 5, the clips 530, 532, 534, 536 are coupled to the U shaped-cores 510, 515, 520, 525 by having a portion of each of the clips 530, 532, 534, 536 pass within each of the U shaped-cores 510, 515, 520, 525 and having the two terminals 540 (not shown), 542 of each preformed clip 530, 532, 534, 536 wrap around the two ends 506, 508 of the inductor 500.

According to an exemplary embodiment, the amorphous powder core material may be initially formed into a sheet and then wrapped around the clips 530, 532, 534, 536. Upon wrapping the amorphous powder core material around the clips 530, 532, 534, 536, the amorphous powder core material and the clips 530, 532, 534, 536 can then be pressed at high pressures, thereby forming the U-shaped inductor 500 having a plurality of U shaped-cores 510, 515, 520, 525 formed as a single structure 505. The press molding removes the physical gap that is generally located between the clips 530, 532, 534, 536 and the cores 510, 515, 520, 525 by having the cores 510, 515, 520, 525 form molded around the clips 530, 532, 534, 536.

According to another exemplary embodiment, the amorphous powder core material and the clips 530, 532, 534, 536 may be positioned within a mold (not shown), such that the amorphous powder core material surrounds at least a portion of the clips 530, 532, 534, 536. The amorphous powder core material and the clips 530, 532, 534, 536 can then be pressed at high pressures, thereby forming the U-shaped inductor 500 having a plurality of U shaped-cores 510, 515, 520, 525 formed as a single structure 505. The press molding removes the physical gap that is generally located between the clips 530, 532, 534, 536 and the cores 510, 515, 520, 525 by having the cores 510, 515, 520, 525 form molded around the clips 530, 532, 534, 536.

Additionally, other methods may be used to form the inductor described above. In a first alternative method, a plurality of U-shaped cores may be formed together by pressing the amorphous powder core material at high pressures, followed by coupling the plurality of windings to each of the plurality of U-shaped cores, and then followed by adding additional amorphous powder core material to the plurality of U-shaped cores so that the plurality of windings are disposed between the plurality of U-shaped cores and at least a portion of the additional amorphous powder core material. The plurality of U-shaped cores, the plurality of windings, and the additional amorphous powder core material are then pressed together at high pressures to form the inductor described in this embodiment. In a second alternative method, two discrete shaped cores, wherein each discrete shaped core has a plurality of shaped cores coupled together, may be formed by pressing the amorphous powder core material at high pressures, followed by positioning the plurality of windings between the two discrete shaped cores, and then followed by adding additional amorphous powder core material. The two discrete shaped cores, the plurality of windings, and the additional amorphous powder core material are then pressed together at high pressures to form the inductor described in this embodiment. In a third alternative method, injection molding can be used to mold the amorphous powder core material and the plurality of windings together. Although a plurality of U-shaped cores are described in this embodiment, other shaped cores may be utilized without departing from the scope and spirit of the exemplary embodiment.

Additionally, the plurality of clips 530, 532, 534, 536 may be connected in parallel to each other or in series based upon circuit connections on a substrate (not shown) and depending upon application requirements. Furthermore, these clips 530, 532, 534, 536 may be designed to accommodate multi-phase current, for example, three-phase and four-phase.

Although several embodiments have been disclosed above, it is contemplated that the invention includes modifications made to one embodiment based upon the teachings of the remaining embodiments.

Although the invention has been described with reference to specific embodiments, these descriptions are not meant to be construed in a limiting sense. Various modifications of the disclosed embodiments, as well as alternative embodiments of the invention, will become apparent to persons having ordinary skill in the art upon reference to the description of the invention. It should be appreciated by those having ordinary skill in the art that the conception and the specific embodiments disclosed may be readily utilized as a basis for modifying or designing other structures for carrying out the same purposes of the invention. It should also be realized by those having ordinary skill in the art that such equivalent constructions do not depart from the spirit and scope of the invention as set forth in the appended claims. It is therefore contemplated that the claims will cover any such modifications or embodiments that fall within the scope of the invention.

What is claimed is:

1. An electromagnetic component, comprising:

at least one shaped-core fabricated from an amorphous magnetically soft powder material, the at least one shaped core having a top surface and a bottom surface opposing the top surface; and at least one preformed conductive winding coupled to the at least one shaped-core, the at least one preformed conductive winding formed with a winding portion and opposing first and second leads, the winding portion including opposing major surfaces and lateral side surfaces interconnecting the opposing major surfaces, the winding portion engaging the top surface of the at least one shape-core and the opposing first and second leads engaging the bottom surface of the at least one shaped-core without being bent around the at least one shaped-core;

wherein the amorphous magnetically soft powder material is a nanoamorphous powder material; and wherein the at least one shaped-core comprises a first shaped-core and a second shaped-core, wherein the winding portion is extended between the first shaped-core and the second shaped-core and wherein the first and second shaped-cores are pressed in surface contact with one another.

2. The electromagnetic of claim 1, wherein the amorphous magnetically soft powder material is an iron-based amorphous powder material.

3. The electromagnetic magnetic component of claim 1, wherein the first shaped core is a U shaped-core and the second shaped-core is an I core.

4. The electromagnetic magnetic component of claim 3, wherein the I core includes the top surface and the bottom surface, the bottom surface further having a first end, the bottom surface configured to receive the first and second leads at the first end and allow the winding portion to be laterally moved across the top surface and away from the first end until the first and second leads reach a predetermined position on the bottom surface, and the bottom surface further configured to prevent movement of the first and second leads beyond the predetermined position.

5. The electromagnetic magnetic component of claim 3, wherein the U shaped-core is symmetrical and includes a first leg, a second leg, and channel extending between the first and second leg, and further wherein the winding portion is situated in the winding channel and the U-shaped core is pressed in surface contact with the winding portion and is pressed in surface contact with at least a portion of the I-core.

6. The electromagnetic component of claim 3, wherein the U shaped-core is asymmetrical and includes a first leg, a second leg, and channel extending between the first and second leg, and further wherein the winding portion is situated in the winding channel and the U-shaped core is pressed in surface contact with the winding portion and is pressed in surface contact with at least a portion of the I-core.

7. The electromagnetic component of claim 1, wherein the at least one preformed conductive winding is a preformed winding clip.

8. The electromagnetic component of claim 7, wherein the winding clip is a C-shaped clip.

9. The electromagnetic component of claim 1, wherein the at least one conductive winding comprises a plurality of windings.

10. The electromagnetic component of claim 1, wherein the at least one preformed conductive winding comprises a plurality of windings.

11. An electromagnetic component, comprising:

a first shaped-core fabricated from an amorphous magnetically soft powder material;

a second shaped-core fabricated from an amorphous magnetically soft powder material;

an electrically conductive preformed winding clip comprising a first lead, a second lead and a winding portion therebetween, wherein the winding portion of the clip is extended between the first shaped-core and the second shaped-core and the first and second leads extend exterior to the first and second shaped-cores without being bent around either of the first and second shaped-cores;

wherein the amorphous magnetically soft powder material is a nanoamorphous powder material, and wherein facing surfaces of the first shaped-core, the second shaped-core, and the winding clip are pressed in surface engagement with one another, thereby eliminating any separation between the winding portion and the amorphous magnetically soft powder material of the first and second shaped-cores.

12. The electromagnetic component of claim 11, wherein the amorphous magnetically soft powder material is an iron-based amorphous powder material.

13. An electromagnetic component, comprising:

a first shaped-core fabricated from a magnetically soft powder material, the first shaped-core having a top surface and a bottom surface;

a second shaped-core fabricated from a magnetically soft powder material, the second shaped-core having a top surface and a bottom surface; and an electrically conductive preformed winding clip comprising a first lead, a second lead and a winding portion therebetween, wherein the winding portion of the clip is extended between the top surface of the first shaped-core and the bottom surface of the second shaped-core and the first and second leads extend on the bottom surface of the first shaped-core without being bent around the first-shaped core, wherein the top surface of the first shaped-core and the bottom surface of the second shaped-core are pressed in surface engagement with one another and are pressed in surface engagement with the winding clip, thereby completely surrounding the winding portion with the magnetically soft powder material of the first and second shaped-cores and so that no gap exists between the magnetically soft powder material and any portion of the winding portion;

wherein at least one of the first and second shaped-cores is shaped from a nanoamorphous magnetically soft powder material.

14. The electromagnetic component of claim 13 wherein at least one of the first and second shaped-cores is shaped from an iron-based magnetic powder material.

* * * * *